US010482718B2

(12) United States Patent
Hendon

(10) Patent No.: US 10,482,718 B2
(45) Date of Patent: Nov. 19, 2019

(54) MODIFIED METHOD AND APPARATUS FOR PLAYING BLACKJACK

(71) Applicant: Rickey R. Hendon, Chicago, IL (US)

(72) Inventor: Rickey R. Hendon, Chicago, IL (US)

( * ) Notice: Subject to any disclaimer, the term of this patent is extended or adjusted under 35 U.S.C. 154(b) by 0 days.

(21) Appl. No.: 15/957,097

(22) Filed: Apr. 19, 2018

(65) Prior Publication Data

US 2018/0240306 A1 Aug. 23, 2018

Related U.S. Application Data

(63) Continuation-in-part of application No. 15/069,437, filed on Mar. 14, 2016, now abandoned.

(51) Int. Cl.
*A63F 9/24* (2006.01)
*G07F 17/32* (2006.01)

(52) U.S. Cl.
CPC ..... *G07F 17/3293* (2013.01); *G07F 17/3267* (2013.01)

(58) Field of Classification Search
CPC . G07F 17/3293; G07F 17/3244; G07F 17/326
See application file for complete search history.

(56) References Cited

U.S. PATENT DOCUMENTS 5,174,579 A * 12/1992 Griffiths ..... A63F 1/00 273/292
6,158,741 A * 12/2000 Koelling ..... A63F 3/00157 273/292
2010/0171267 A1* 7/2010 Walker ..... G07F 1/06 273/274
2010/0327529 A1* 12/2010 Goodwin ..... A63F 3/00157 273/292
2011/0089636 A1* 4/2011 Smith ..... G07F 17/32 273/292
2012/0094743 A1* 4/2012 Odom ..... G07F 17/3244 463/20

* cited by examiner

*Primary Examiner* — Steve Rowland
(74) *Attorney, Agent, or Firm* — Fraline J. Allgaier

(57) ABSTRACT

A modified method of playing a blackjack style bonus game that includes additional wagering options for players. Various double down options are provided for players to increase their chances of winning by receiving additional cards from a blackjack card deck incorporating at least two specialized wild cards. The game begins by receiving a first hand value between 12 and 17 and electing a bonus wagering option that the next card will produce a 21 without busting. After receiving a third card count less than 21, electing a second bonus option and winning on the ratio of 20 to 1 if the additional blackjack cards or specialized wild cards add up to 21 without busting. The dealer settles the bonus wagers and the traditional game of blackjack continues.

7 Claims, 7 Drawing Sheets

MODIFIED METHOD AND APPARATUS FOR PLAYING BLACKJACK

RELATED APPLICATIONS

This application is a continuation-in-part of U.S. Utility patent application Ser. No. 15/069,437 filed Mar. 7, 2016, now abandoned.

BACKGROUND OF THE INVENTION

The present invention is related to a method for playing blackjack with bonus wagers that may be integrated into the traditional rules for playing blackjack. This new blackjack wagering method seeks to improve a player's gaming experience by providing additional bonus wagers in favor of the player.

Blackjack is a card game that is traditionally played in casinos or similar wagering environments throughout the world. It is a banking-style game in which each player attempts to achieve points closer to 21 but without exceeding that number. Blackjack is traditionally played with a standard deck of fifty-two playing cards. Each player is required to make an initial wager in order to be a part of the game. The game begins with the players receiving two cards faced down, while the dealer receives one card faced down and the second card exposed. After the cards have been dealt, the game proceeds in a clockwise direction. Each player can keep his hand (stand) or request more cards from the deck (hit) until each player decides that the hand is strong enough to beat the dealer's hand. If the hand goes over 21, the player immediately loses the game (busts). The dealer reveals the hidden card after all players have decided to stand or bust in accordance with the rules of the wagering establishment. Conventionally, house rules require that the dealer stands on his hand if his hand count is seventeen or more. He is required to take hits if his initial hand is sixteen or less and obtains hits until his hand is seventeen or more. If the dealer's two cards add up to 21, the dealer has obtained a blackjack and stands. If the dealer's cards exceed 21 (bust) each player who has not busted wins. If the dealer does not exceed 21, the hand count of each player is compared to that of the dealer. The players with hands exceeding the dealer's hand win according to established house rules. If the dealer and the players tie, there is a push. Depending on the rules of the establishment, the players either lose or retain their wagers. In some variations of the game, players with a blackjack are classified as push hands and the bet is returned to the player.

Additional blackjack side rules allow a player to double down (double his initial wager), split identical cards of the same rank or make an insurance bet. A player decides to double down if the player's initial two cards total a number established by initial house rules. Common double down hands include (1) nine; (2) ten or eleven; and (3) eleven only. Based on the card count, the player elects to double down and places an additional wager that is equal to the amount of his initial wager. The player receives a third card and the three-card count is compared to the dealer's final hand. The player's total bet is the amount of the player's initial bet and the double down bet.

If a player splits identical cards, he must make an additional wager that is equal to his initial bet. If the second card dealt to a split ace is a 10-point card, a player does not receive the blackjack bonus for this hand. He does however win against an ordinary 21 made of more than two cards. If the dealer also has a blackjack the result for this hand is a push. In many places, the same rule (no blackjack bonus) is played if an ace is dealt as the second card to a 10-point card after splitting.

A player has the opportunity to make an insurance wager if the dealer draws an ace as the face-up card. The game proceeds with the dealer asking the players if they want to take insurance. The insurance wager is typically limited to half of the player's initial wager. The insurance wager is made in case the dealer receives a blackjack. The dealer then peeks at his face down card to check if he has a blackjack. The dealer reveals his hand and each player placing an insurance bet wins for the insurance bet only and the payout is based on established house rules. All players who do not have a hand adding up to twenty-one lose their initial bet.

Large payouts are typically not available in blackjack games. In addition, most blackjack variations allow a player to double down on a hand with an opening hand worth 11, 10 or 9. Players are not allowed to hit after a double down wager and house rules do not provide for a bonus payout if the additional card count reaches 21. When you've chosen to double down, a player only gets one additional card from the dealer and the payout would be based on the initial wager and the double down wager. Most blackjack variations benefit the dealer more than the players and also provide low payouts. This wagering method is limiting and produces lower payouts. In addition, most players become bored with the game and expect low returns from their wagers.

To this end, this new method for playing blackjack with bonus wagers provides favorable wagering options for players and thereby increasing the appeal of the game. A player is more likely to retain interest in a game with additional opportunities to wager and possibly win higher payouts. The present invention allows the players to risk additional wagers based on a plurality of exposed card combinations. A player receives a first hand and can take a hit if the first hand combination is higher than 11 and the player can achieve a total card count of 21. A player showing an exposed hand combination of twelve through seventeen is more likely to make a double down bonus bet as provided by the rules and payouts of the present intention. The player can make the second bonus bet that an additional card can produce a card count of twenty-one. The excitement of the game continues as the winner of the first or second bonus rounds receive big payouts of 10 to 1.

BRIEF SUMMARY OF THE INVENTION

It is therefore an objective of the present invention to provide a blackjack bonus wagering method wherein each player can receive higher payouts with bonus wagering options.

In accordance with the present invention there is provided a blackjack bonus wagering method that can be played in a traditional blackjack casino table with a deck of blackjack wagering cards incorporating at least two specialized wild cards. The specialized wild cards automatically produce a total hand count of 21. The table layout incorporates the traditional blackjack wagering area and has locations for a first and a second bonus wagering option. The first bonus wagering option producing a payout of 10 to 1. The second bonus wagering option having a higher payout of 20 to 1.

At the beginning of the game, the player places an initial bet in the first wagering area. The player receives two cards faced up while the dealer receives one card faced down and the other faced up. The player can make a first initial bonus wager if the sum of the first two cards is a twelve through seventeen. The outcome of the first bonus wager is determined if the player's first initial card count is a twelve through seventeen and the third hit card produces a total card count of twenty-one. The dealer resolves the first wager bonus and the game proceeds according to the traditional rules of blackjack.

The player can further elect a second bonus wager and receive additional hit cards if a 21 card count is not received with the first hit and the player has not busted. The dealer continues to hit the player's card until the player obtains a hand value of 21 or bust. The dealer resolves the second bonus bet and the game proceeds according to the traditional rules of blackjack.

This modified method of playing blackjack retains all of the features and advantages of traditional blackjack and does not change the card sequence of the game. The game retains the traditional excitement and anticipation associated with the game of blackjack. It can be incorporated into blackjack games using various deck counts including single or multiple deck modes.

DETAILED DESCRIPTION OF THE INVENTION

The detailed description is for illustrative purposes and does not limit the scope of the present invention. The embodiments described below provide sufficient information to enable a person having ordinary skill in the art to practice the invention. It should be understood that other embodiments can be practiced with multiple variations without departing from the scope of the invention.

Figure 1:
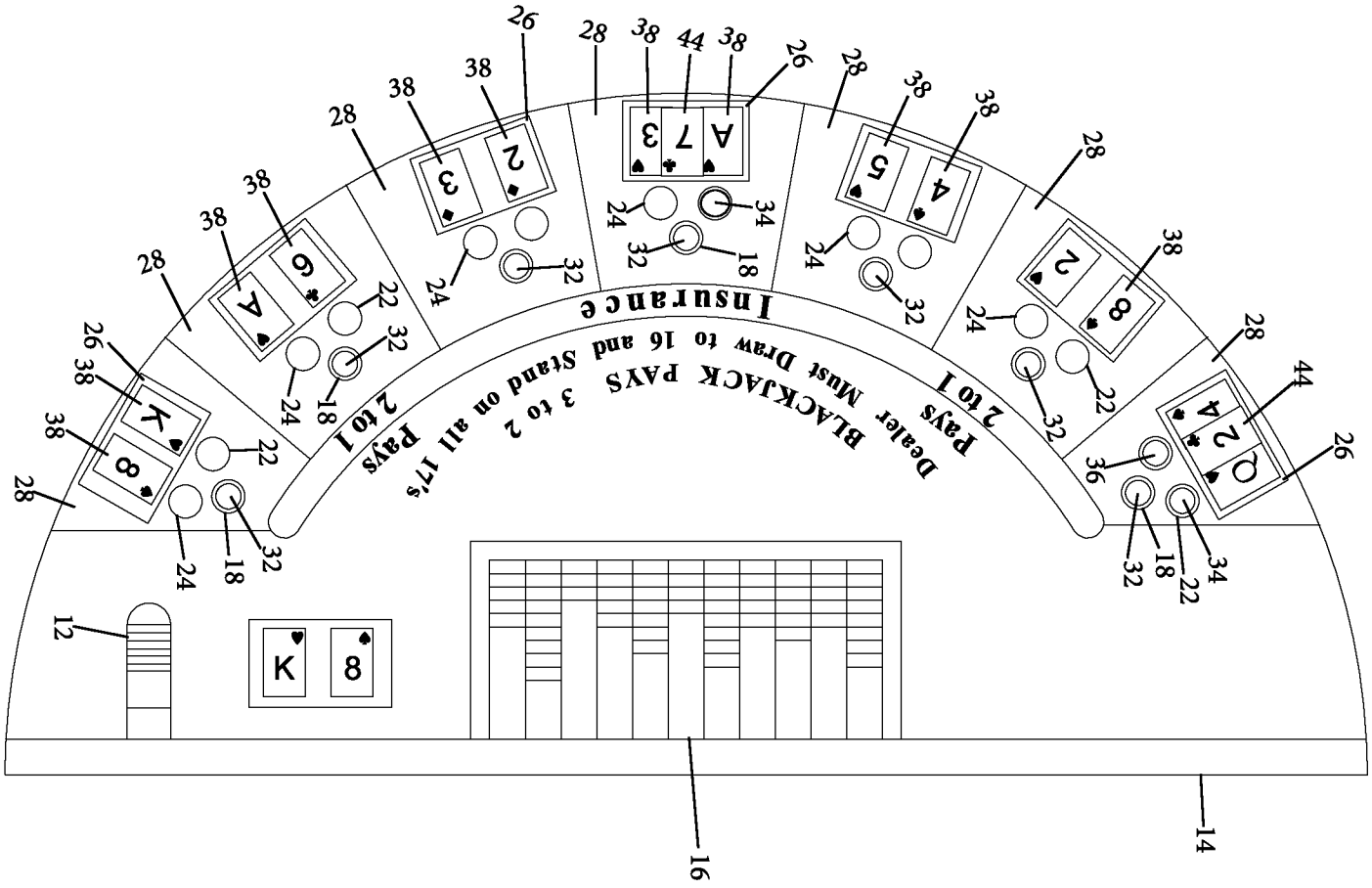
FIG. 1 illustrates a table layout of one embodiment of the present invention.

Referring now to the drawings, FIG. 1 shows a blackjack-wagering table 14 in accordance with the preferred embodiment of the present invention. The blackjack wagering table 14 has a layout including blackjack playing cards 12 and at least two specialized wild cards 13, a dealer location 16, an initial wagering area 18, a first bonus wagering area 22, a second bonus wagering area 24, a card area 26 and a plurality of player locations 28. The blackjack game of the present invention incorporates the standard rules for blackjack including the blackjack playing cards 12 having the following established card values: Ace—10 or 11, King—10, Queen—10, Jack—10 and all other cards keeping their face value. The specialized wild cards 13 automatically producing a total hand count of 21. The initial wager of at least one player in the initial wagering area 18 starts the game. The preferred method of playing blackjack in accordance with the present invention consists of an initial bet 32, a first bonus bet 34 and a second bonus bet 36, wherein said players place an initial bet 32 in the initial wagering area 18 before the game begins.

A player receives a first hand 38 comprising two cards dealt face up while the dealer receives the first card faced down and the second card faced up. In a multiple player format, the dealer proceeds by dealing in rotation after each player has received his or her cards. A first hand 38 count from twelve through seventeen gives each player an option to elect an established first bonus wager 22 that the next card being dealt by the dealer will produce a total card count of twenty-one. The dealer produces a third card 44 on top of the first hand in the card area. The dealer resolves the first bonus wager if the third card 44 is twenty-one and the game proceeds according to the traditional rules of blackjack.

Each player receiving a total card count less than twenty-one after a third card 44 is dealt has the option to place a second bonus bet 26 that any subsequent card will not produce a bust. The player places a second bonus bet 36 on the second bonus wagering area, the dealer hits the player's card until the player obtains a hand value of 21 or bust. The dealer resolves the double down bet according to the rules of the present invention by providing a payout of 10 to 1 and the blackjack game proceeds according to the traditional rules of blackjack.

Figure 2:
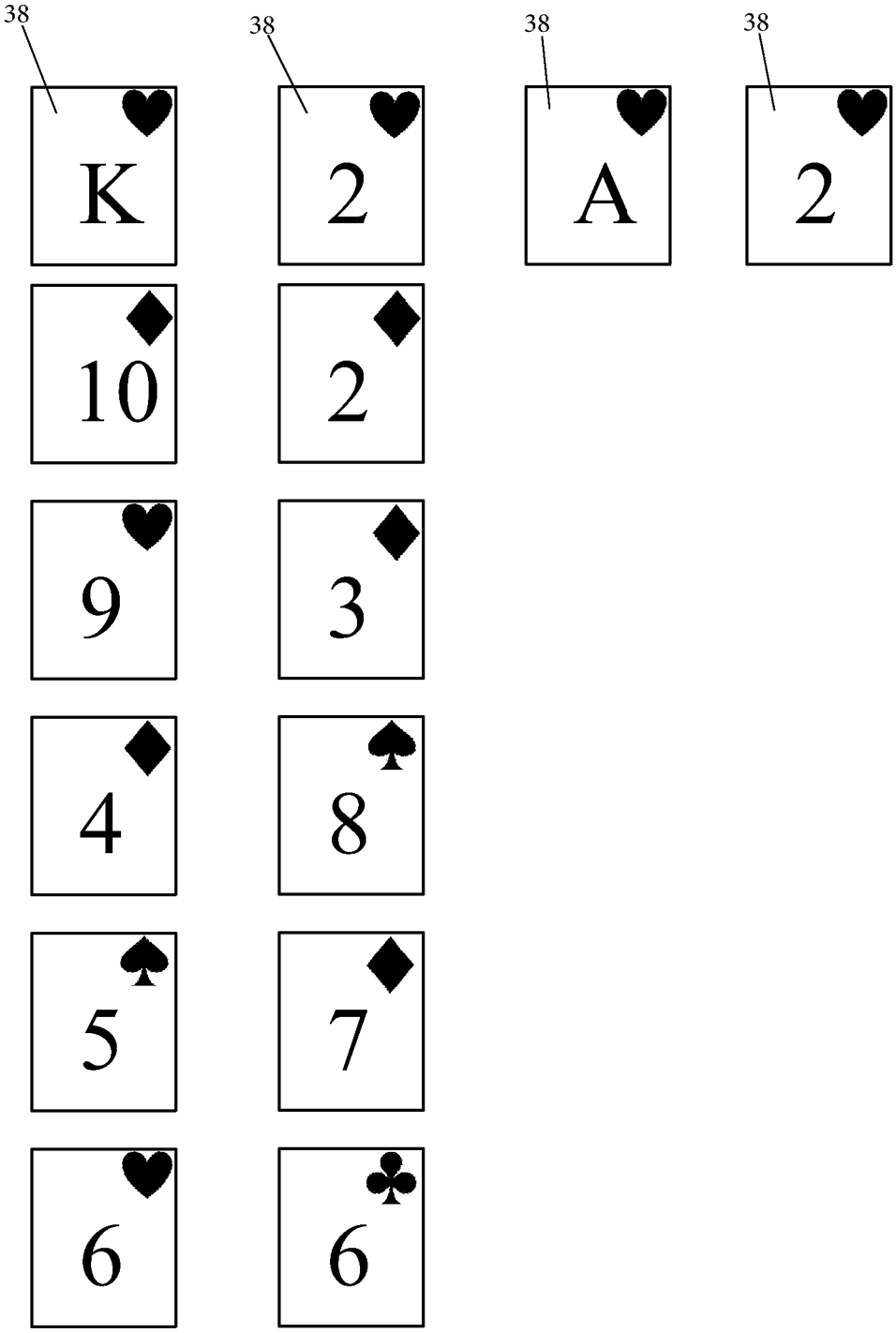
FIG. 2 illustrates a plurality of card strategies in accordance with the preferred embodiment of the present invention.
Figure 3:
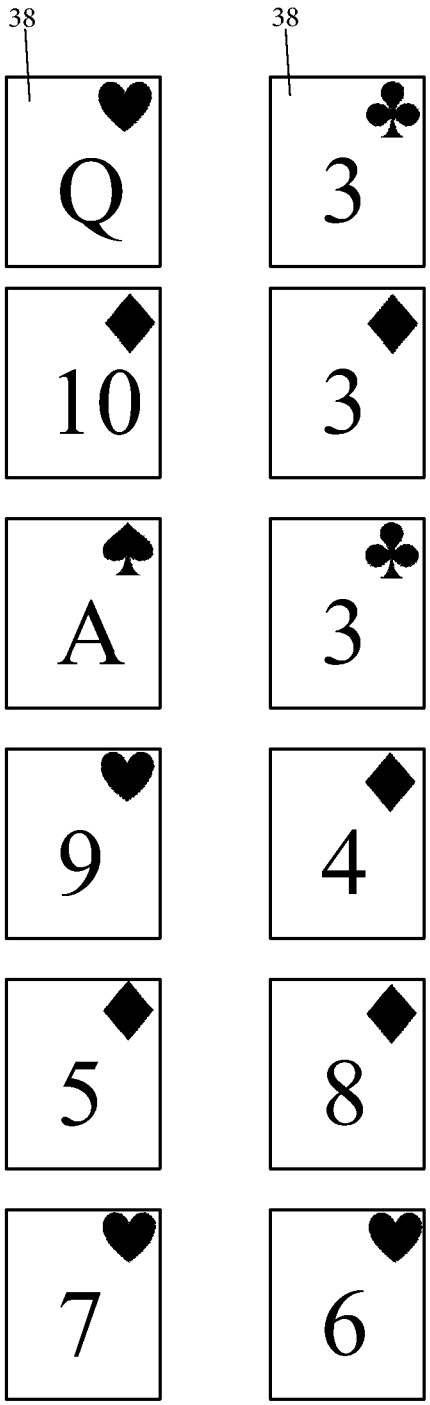
FIG. 3 illustrates a plurality of card strategies in accordance with the preferred embodiment of the present invention.
Figure 4:
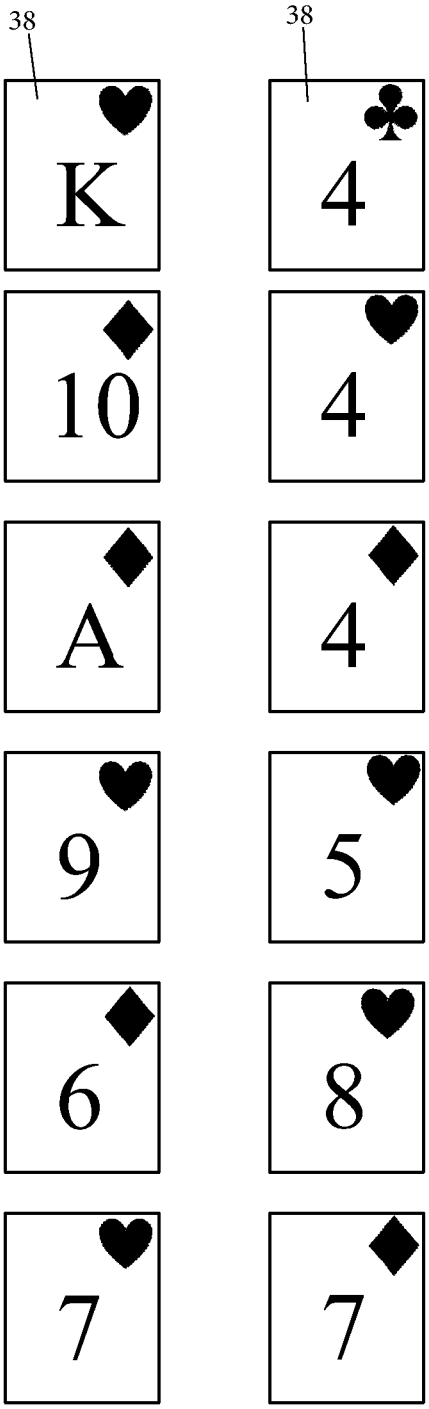
FIG. 4 illustrates a plurality of card strategies in accordance with the preferred embodiment of the present invention.

FIG. 2 is an exemplary chart of the first hand 38 combinations according to the present invention. The wagering facility can determine the minimum wager values and payouts for the first bonus bet 34 and the second bonus bet 36. The player receives a payout based on the sum of the first bonus wager 34 and the second bonus wager 36.

Figure 5:
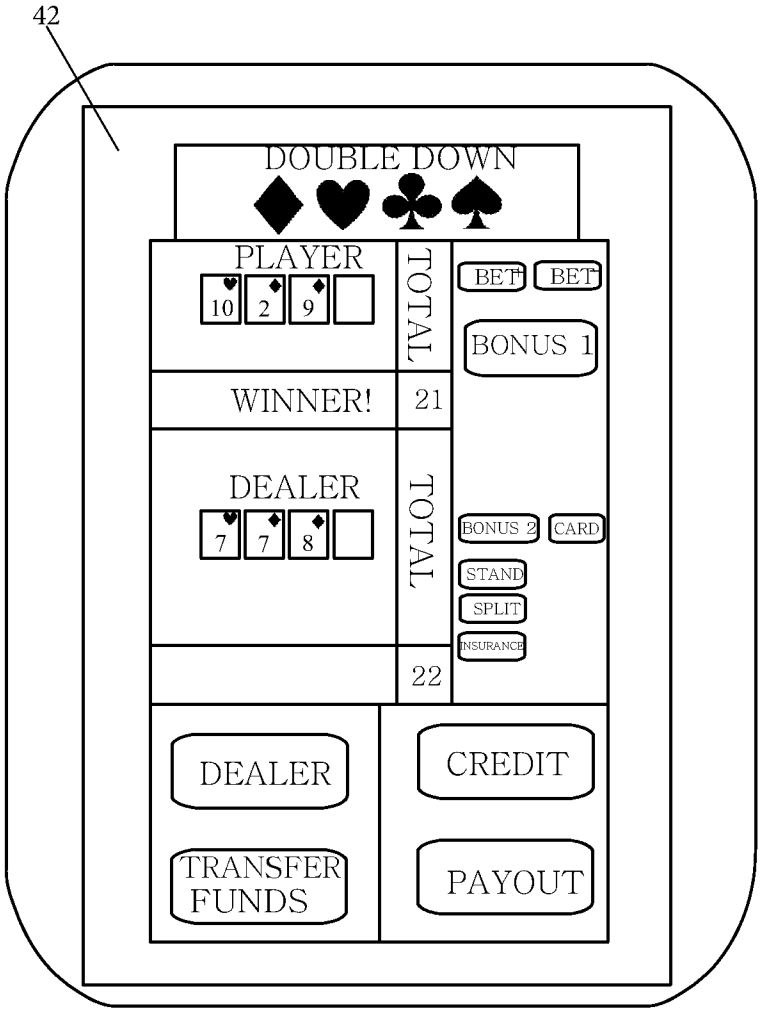
FIG. 5 illustrates a gaming device of a second embodiment of the present invention.
Figure 6:
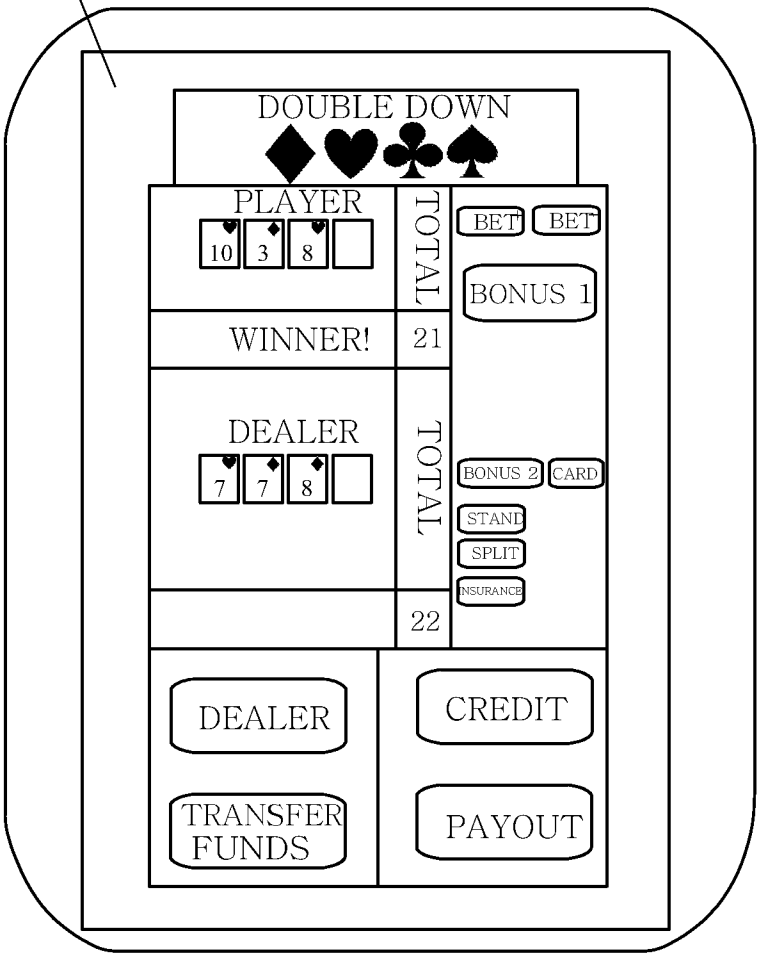
FIG. 6 illustrates a gaming device of a second embodiment of the present invention.
Figure 7:
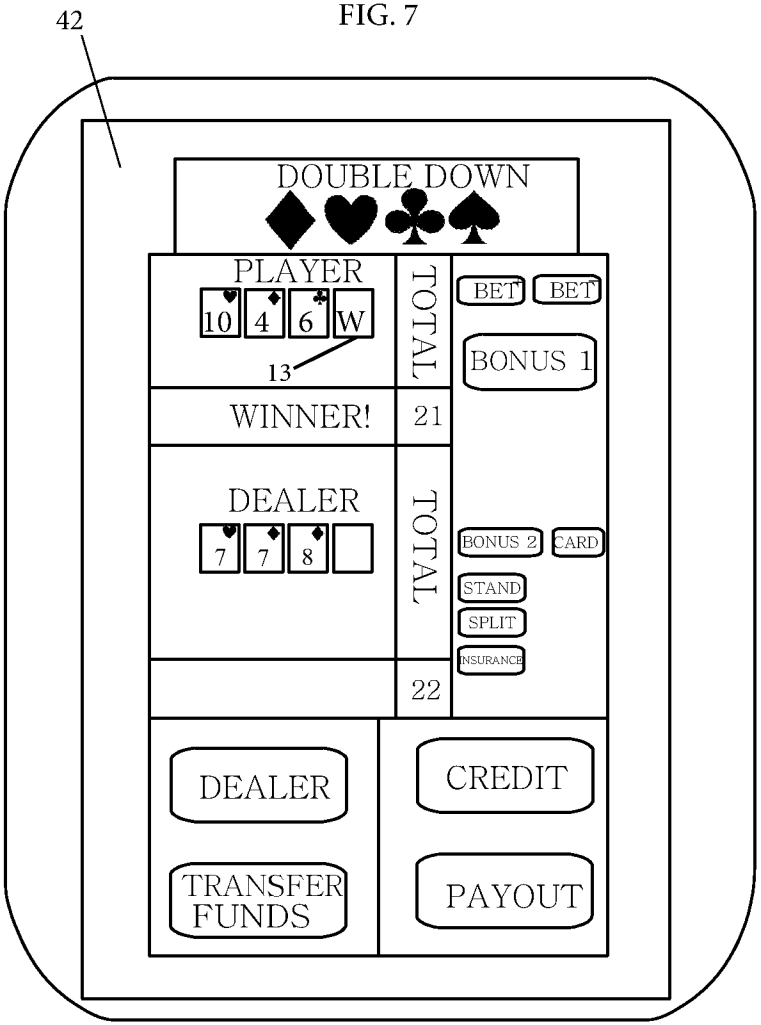
FIG. 7 illustrates a gaming device of a second embodiment of the present invention.

FIGS. 5-7 shows the modified blackjack method being played on a live electronic screen 42 wherein the players are afforded the initial bet 32, the first bonus bet 34, and the second bonus bet 36 as prescribed in the present invention. The player is dealt a typical initial blackjack deal with first hands 38 having card counts between 12 and 17. Each player can decide to make the first bonus bet 34 and the second bonus bet 36.

What is claimed is:

1. A modified method for playing blackjack using a deck of blackjack playing cards and at least two wagering areas, said method comprising:

having at least two specialized wild cards integrated in said deck of said blackjack playing cards, said specialized wild cards automatically producing a total hand count of 21;

wagering consisting of an initial bet, a first bonus bet and a second bonus bet, wherein said initial bet is placed in said initial wagering area before the game begins at a wagering facility;

a player receiving a first hand comprising two cards, said first hand having a card count from 12 through 17, electing an established double down wager that said third card will produce a total card count of 21, placing a bet on said first bonus wagering area, said dealer producing a third card on top of said first hand in said card area, receiving a third card on top of said first hand in said card area, receiving a total card count less than twenty one after a third card is dealt, electing a second bonus bet that any subsequent card will not produce a bust, placing a bet on said second bonus wagering area, receiving additional of said blackjack playing cards and said specialized wild card until said first hand has a hand value of 21 or bust, winning on the ratio of 20 to 1 if said additional blackjack playing cards and said specialized wild card add up to 21, said blackjack game proceeding according to the traditional rules of blackjack.

2. The method of claim 1 wherein said first hand can include an ace and any card with a denomination of two.

3. The method of claim 1 wherein said first hand can include an ace and two face or number cards with a total value of 21.

4. The method of claim 1 wherein said wagering facility determines the minimum amount of the first bonus wager.

5. The method of claim 1 wherein said wagering facility determines the minimum amount of the second bonus wager.

6. The method of claim 1 wherein said player receives a payout based on the sum of said double down bet and said initial wager.

7. A method of playing blackjack according to claim 1 wherein said method is displayed on an electronic screen.

* * * * *